US010240907B2

(12) United States Patent
Berger

(10) Patent No.: US 10,240,907 B2
(45) Date of Patent: Mar. 26, 2019

(54) BULLET CARTRIDGE AND CASE TESTING DEVICE

(71) Applicant: AusKur Firearms and Munitions, Inc., Nampa, ID (US)

(72) Inventor: Leo Berger, Nampa, ID (US)

(73) Assignee: AUSKUR FIREARMS AND MUNITIONS, INC., Nampa, ID (US)

( * ) Notice: Subject to any disclaimer, the term of this patent is extended or adjusted under 35 U.S.C. 154(b) by 162 days.

(21) Appl. No.: 15/624,507

(22) Filed: Jun. 15, 2017

(65) Prior Publication Data

US 2017/0363399 A1 Dec. 21, 2017

Related U.S. Application Data

(60) Provisional application No. 62/351,163, filed on Jun. 16, 2016.

(51) Int. Cl.
*F42B 35/02* (2006.01)

(52) U.S. Cl.
CPC ..... *F42B 35/02* (2013.01)

(58) Field of Classification Search
CPC ..... F42B 35/02
USPC ..... 33/506, 550, 551
See application file for complete search history.

(56) References Cited

U.S. PATENT DOCUMENTS

| | | | | |
|---|---|---|---|---|
| 656,009 | A | 8/1900 | Bergersen | |
| 892,230 | A | 6/1908 | Donati | |
| 3,510,951 | A * | 5/1970 | Dow | G01B 3/50 33/506 |
| 4,325,282 | A | 4/1982 | Schaenzer | |
| 4,918,825 | A * | 4/1990 | Lesh | F42B 35/02 33/506 |
| 5,301,436 | A * | 4/1994 | Johnston | F42B 35/02 33/506 |
| 5,430,966 | A | 7/1995 | Hippensteel | |
| 6,151,788 | A * | 11/2000 | Cox | G01B 11/27 33/286 |
| 7,716,845 | B1 * | 5/2010 | Willis | G01B 5/20 33/506 |
| 9,513,097 | B1 * | 12/2016 | Sheridan | G01B 5/0023 |
| 2006/0248739 | A1 * | 11/2006 | Cauley | F41A 31/00 33/506 |
| 2013/0219728 | A1 * | 8/2013 | Hartman | G01B 3/205 33/506 |
| 2014/0196300 | A1 * | 7/2014 | Williamson, IV | G01B 3/28 33/701 |
| 2015/0300776 | A1 | 10/2015 | Lee et al. | |

* cited by examiner

*Primary Examiner* — George B Bennett
(74) *Attorney, Agent, or Firm* — Jeffer Mangels Butler & Mitchell LLP; Brenna C. Swain, Esq.

(57) ABSTRACT

An ammunition inspection assembly that includes a cartridge tester having a main body portion with a bore extending axially therethrough, a bullet pusher, and a case pusher. The bore includes an inner surface, a front opening and a rear opening and is configured to receive a bullet cartridge therein.

15 Claims, 7 Drawing Sheets

BULLET CARTRIDGE AND CASE TESTING DEVICE

CROSS REFERENCE TO RELATED APPLICATIONS

This application claims the benefit of U.S. Provisional Application No. 62/351,163, filed Jun. 16, 2016, the entirety of which is incorporated by reference herein.

FIELD OF THE INVENTION

The present invention relates generally to a bullet cartridge and case testing device, and more particularly to a bullet cartridge and case testing device that also includes components for removing a stuck cartridge or case.

BACKGROUND OF THE INVENTION

Bullet cartridges are subject to jamming or failure when placed in the chamber of a firearm. Furthermore, bullet casings are often reused. However, if the casing has been damaged at all during prior use it can easily cause a failure or jam. Accordingly, a need exists for a testing device to help prevent the issues discussed above. U.S. Pat. Nos. 4,325,282, 5,430,966, 656,009, 892,230 and U.S. Patent Publication No. 2015/0300776 are incorporated by reference herein in their entireties.

SUMMARY OF THE PREFERRED EMBODIMENTS

In accordance with a first aspect of the present invention there is provided an ammunition inspection assembly that includes a cartridge tester having a main body portion with a bore extending axially therethrough, a bullet pusher, and a case pusher. The bore includes an inner surface, a front opening and a rear opening and is configured to receive a bullet cartridge therein. In a preferred embodiment, the main body portion of the cartridge tester includes a minimum tolerance surface flush with the front opening of the bore and a maximum tolerance surface positioned on a protrusion extending outwardly from the minimum tolerance surface. Preferably, the main body portion of the cartridge tester includes a mean tolerance surface positioned on the protrusion at a location between the minimum tolerance surface and the maximum tolerance surface.

In a preferred embodiment, the bullet pusher includes an alignment portion that is configured to be received in an alignment recess defined in the front of the cartridge tester. Preferably, the bullet pusher includes a pushing portion extending from the alignment portion. The pushing portion is configured to be received in the front opening of the bore of the cartridge tester. In a preferred embodiment, the pushing portion has a concave front surface. Preferably, the bullet pusher includes a case pusher opening extending rearwardly from the concave front surface. The case pusher opening is configured to receive a portion of the case pusher therein.

In a preferred embodiment, an inner surface of the alignment recess defines the minimum tolerance surface that is flush with the front opening of the bore. Preferably, the alignment recess divides the front of the main body portion of the cartridge tester into first and second members that each include a maximum tolerance surface positioned on a protrusion extending outwardly therefrom. In a preferred embodiment, the mean tolerance surface is positioned on each of the first and second protrusions at a location between the minimum tolerance surface and the maximum tolerance surface. In a preferred embodiment, the ammunition inspection assembly also includes a bullet case extractor groove tester secured to an outer surface of the cartridge tester.

The invention also includes the method of inserting a bullet cartridge into the bore through the rear opening and checking the size of the bullet to determine if the front tip of the bullet does not extend through the front opening and past the minimum tolerance surface(s) or if the bullet extends past the maximum tolerance surface(s). The method also includes placing the concave surface of the bullet pusher against the tip of the bullet, aligning the alignment member with the alignment recess and pushing the bullet cartridge rearwardly through the rear opening. The method also includes inserting the case pusher into the front opening of a stuck case until the distal end of the case pusher is against the inner surface of the rim of the case and pushing the case rearwardly through the rear opening. In an embodiment, the method includes inserting the proximal end of the case pusher into the case pusher opening in the bullet pusher and then pushing the flange of the bullet pusher to expel the case from the cartridge tester.

In accordance with another aspect of the present invention there is provided a bullet case extractor groove tester that includes a semi-circular shaped main body portion that includes a trough defined axially therethrough. The trough includes an inner surface and first and second semi-annular protrusions that define a rim channel therebetween. The rim channel is configured to receive the rim of a bullet case and the first semi-annular protrusion is configured to be received in the extractor groove of the bullet case. In a preferred embodiment, the bullet case extractor groove tester is combined with a case or a bullet cartridge.

In a preferred embodiment, the first semi-annular protrusion includes a front inclined surface, an inner surface that is generally parallel to an axis of the main body portion, and a rear surface that is generally perpendicular to the axis of the main body portion. Preferably, the main body portion includes an attachment channel defined therein. The attachment channel can extend axially to the main body portion or perpendicular thereto.

The invention also includes the method of placing a case in the trough such that the rim channel receives the rim of a bullet case and the first semi-annular protrusion is received in the extractor groove of the bullet case, and then spinning or rotating the bullet case (or cartridge) about its axis to smooth the extractor groove.

It will be appreciated that the present invention is a system for ammunition inspection and resizing that includes a contoured cylinder or rectangle (manufactured of, e.g., aluminum or steel) that has internal and external machining performed to approximate a firearm chamber of a particular caliber and type. The purpose is to reference a factory new or reloaded round inserting into a firearms chamber thus allowing observation of obstruction or interference that would limit the function of the firearm; i.e., a jam or failure to fire. Another purpose is visual reference of minimum, maximum and mid/mean condition: COL (cartridge overall length). The device also provides visual reference of minimum and maximum head space condition, visual reference of LEDE and Bore interference (to do with interaction of COL and built shape), and visual reference of built case sizing prior to re-priming, powder loading and built insertion.

The system includes a bullet pusher that can be used to remove a bullet jammed or stuck in the chambered reference, a case pusher used in conjunction with the bullet pusher (or alone) to remove a bare case jammed or stuck in the chambered reference, and an extractor groove tester that provides visual reference of the condition of extractor groove and lands. The extractor groove tester also provides manual smoothing of inconsistent extractor groove and lands.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
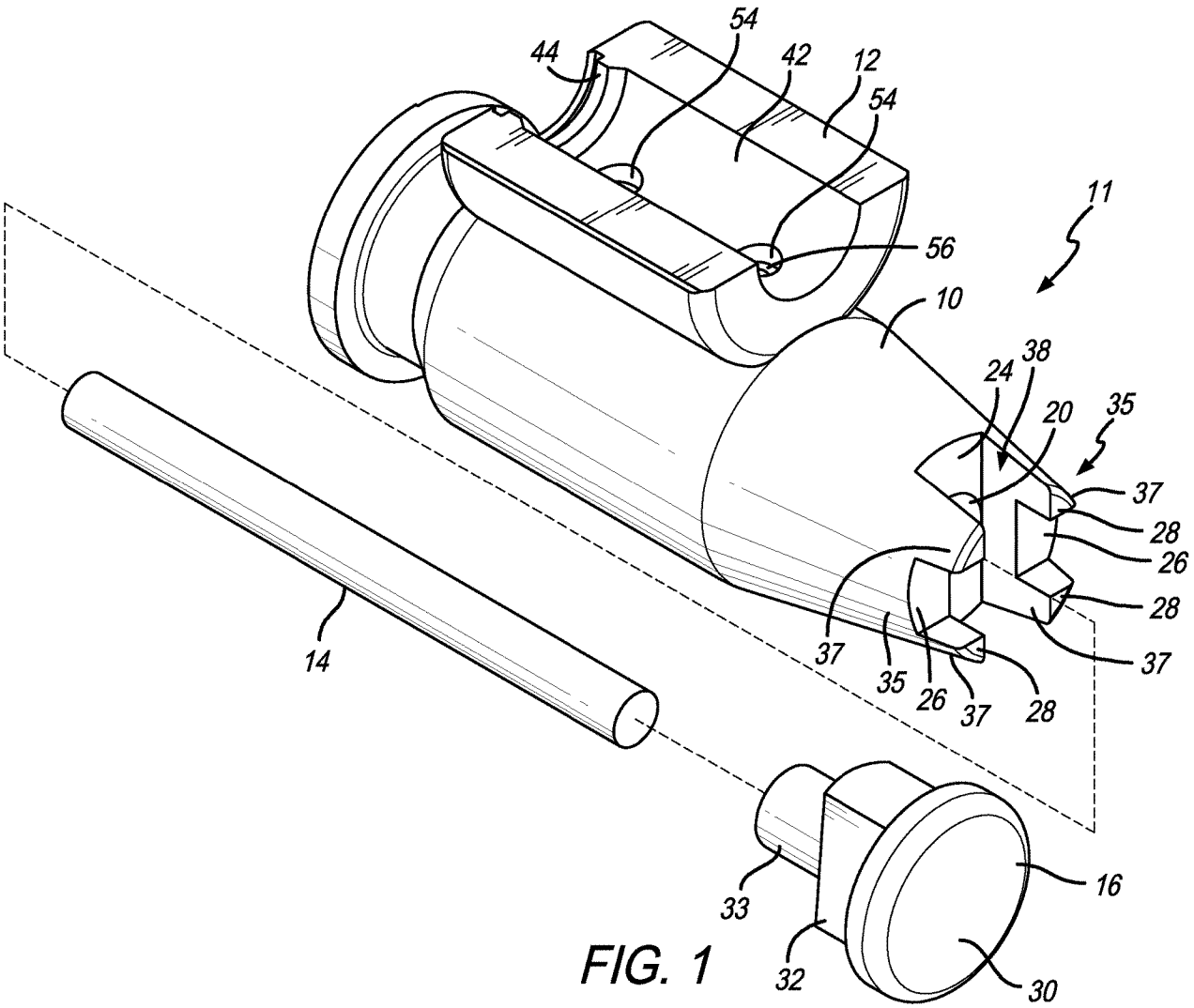
FIG. 1 is an exploded perspective view of an ammunition inspection assembly or system in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, FIGS. 1-10 show an ammunition inspection assembly 11 or testing system. The system 11 can be used to check the size or condition of new or reloaded ammunition before use and used casings before reloading with a bullet and to remove the casing or bullet if they get stuck. As shown in FIG. 1, the system 11 generally includes a chambered reference or cartridge tester 10, an extractor groove tester 12, a case rod or case pusher 14, and a bullet pusher 16.

As shown in FIGS. 1-4, the cartridge tester 10 includes a main body portion 17 that includes a through bore 18 having front and rear openings 20 and 22. The through bore 18 mimics or is sized to replicate the chamber of a firearm. The cartridge tester 10 and through bore 18 can be sized for any caliber or size firearm. The grooves, slots and surfaces 15 in the through bore 18 reference the minimum and maximum for the headspace of the firearm. It will be appreciated by those of ordinary skill in the art that a bullet cartridge 100 includes a case 102 and a bullet 104, and the case 102 includes an extractor groove 106.

In a preferred embodiment, the front end of the main body portion 17 includes a minimum tolerance surface 24 (that is flush with the front opening 20), a mean tolerance surface 26 and a maximum tolerance surface 28. These surfaces are related to the cartridge overall length (COL) minimum and maximum. See the "COL" in FIG. 4. In use, when a cartridge 100 is inserted through rear opening 22 and into the through bore 18, if the cartridge is longer than the maximum (extends past maximum tolerance surface 28) or shorter than the minimum (does not extend past minimum tolerance surface 24 or through front opening 20), the cartridge 100 is not to specification and should not be used (as the cartridge may not be seated properly).

Figure 2:
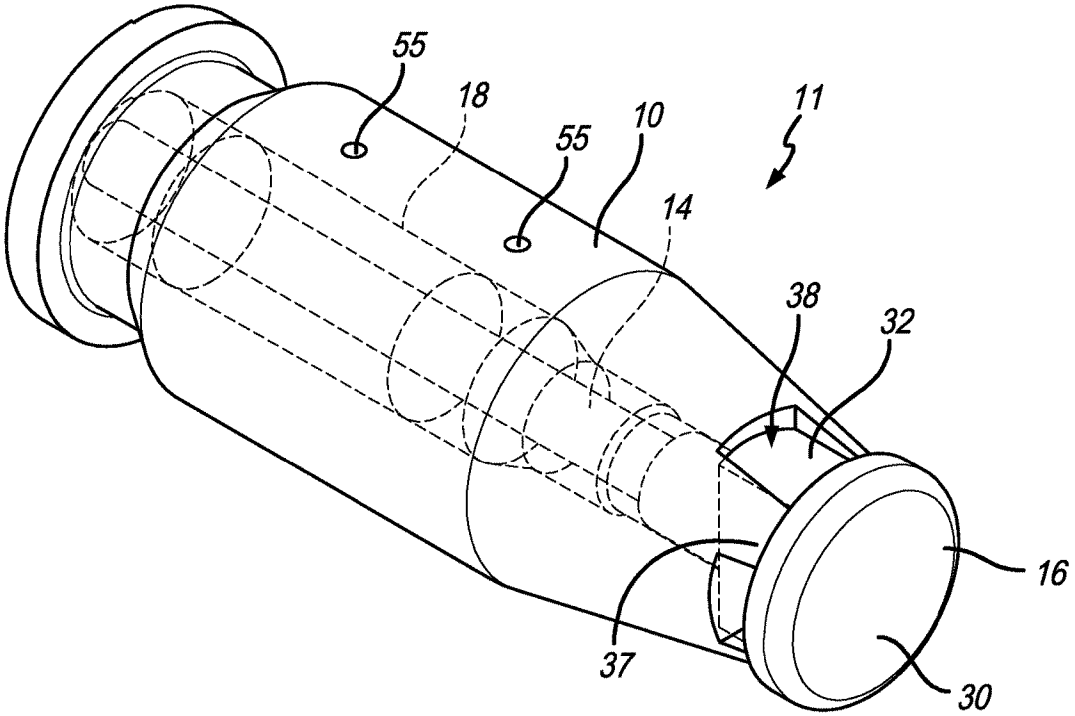
FIG. 2 is a perspective view of the ammunition inspection assembly of FIG. 1 with the case pusher inserted into the cartridge tester and the extractor groove tester omitted.
Figure 3:
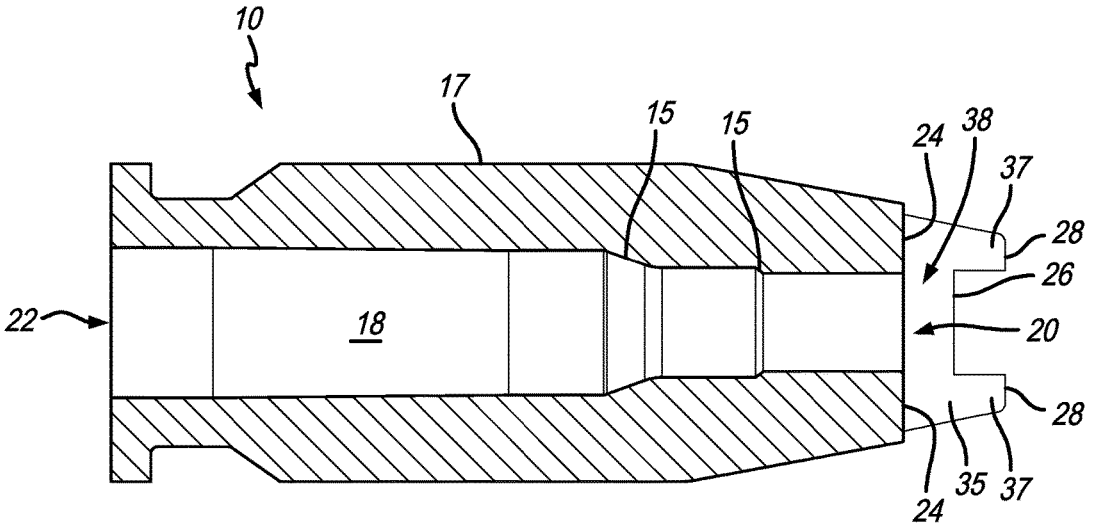
FIG. 3 is a cross-sectional elevational view of the cartridge tester.
Figure 4:
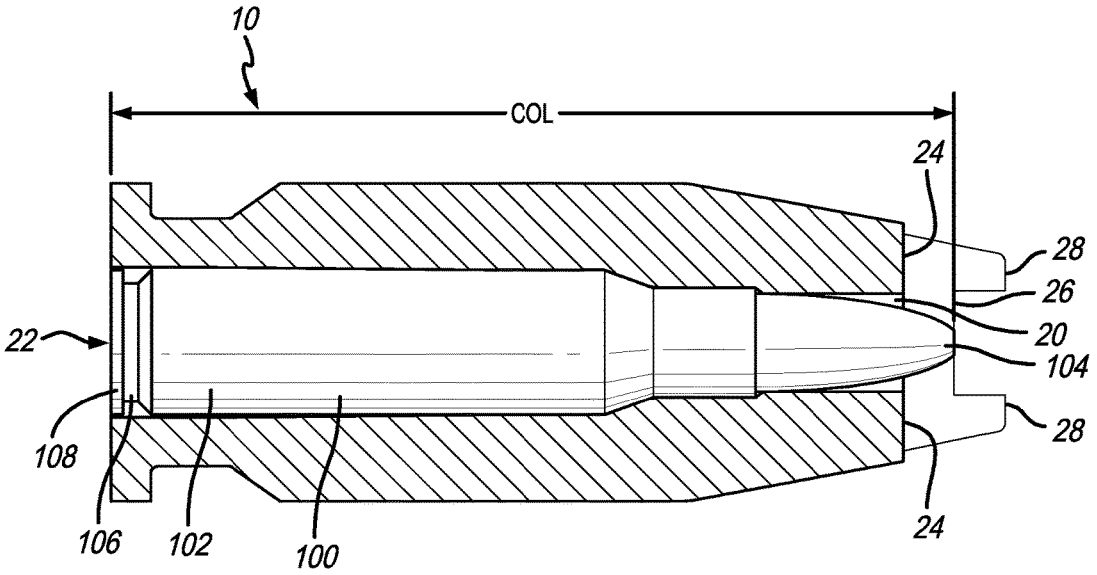
FIG. 4 is a cross-sectional elevational view of the cartridge tester with a bullet cartridge therein.
Figure 5:
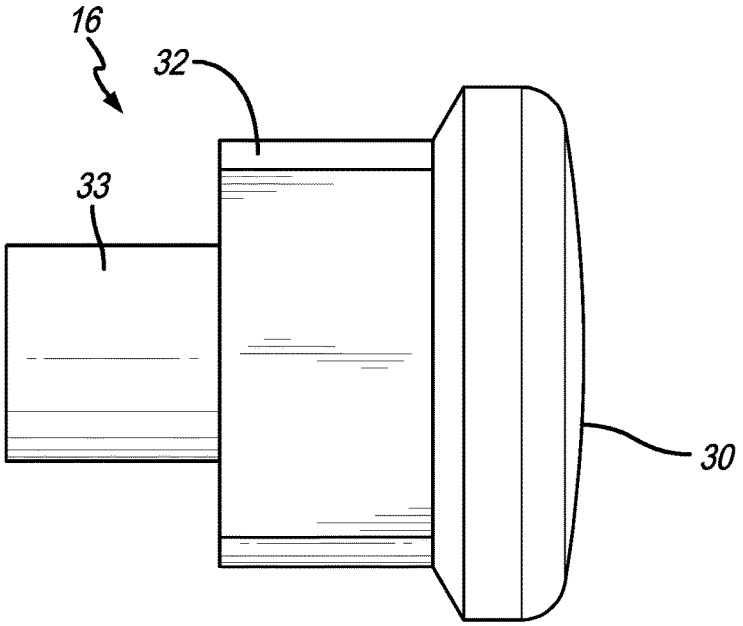
FIG. 5 is an elevational view of the bullet pusher.
Figure 6:
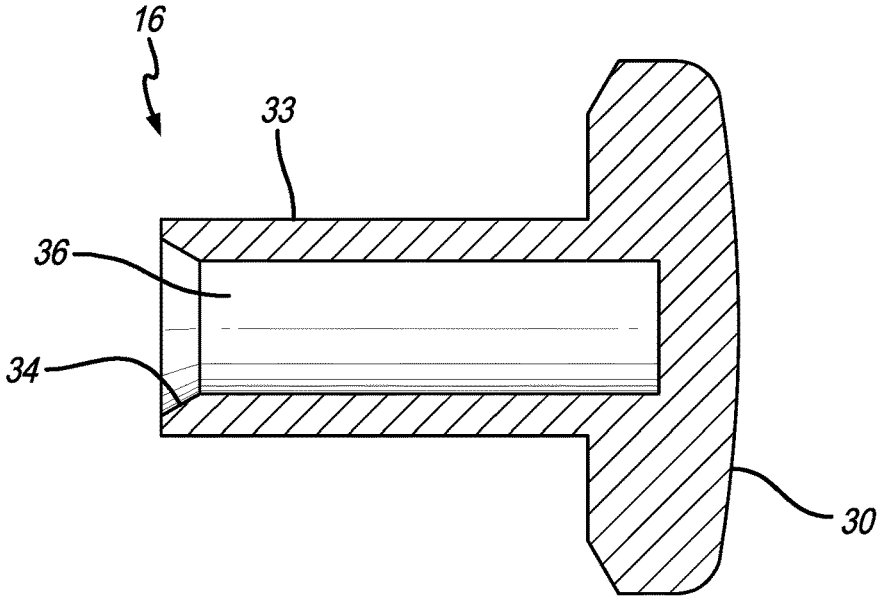
FIG. 6 is a cross-sectional elevational view of the bullet pusher.

As shown in FIGS. 1 and 5-7B, the bullet pusher 16 generally includes a flange portion 30, an alignment portion 32, a pushing portion 33, a concave front surface (or counter bore) 34 and a case pusher opening 36 axially defined through the concave front surface 34. The concave surface 34 can be curved or flat. As shown FIG. 7A, a cartridge 100 can sometimes get stuck in the through bore 18 if there is an issue with the size thereof. The bullet pusher 16 can be used to push a bullet rearwardly out of the through bore 18. The pushing portion 33 is sized to fit through front opening 22 of the cartridge tester 10. An alignment recess 38 is defined in the front of the main body portion 17 of the cartridge tester 10. In a preferred embodiment, the inner surface of the alignment recess is coincidental or the same surface as the minimum tolerance surface 24. The alignment portion 32 of the bullet pusher 16 is sized to fit or be received in the alignment recess 38, such that the front surface of the alignment portion 32 contacts the minimum tolerance surface 24 (or inner surface of the alignment recess), and the inner surface of the flange 30 contacts the maximum tolerance surfaces 28, which are the outer surfaces of the four protrusions 37 as shown in FIG. 2. As shown in FIG. 1, the defining of the alignment recess 38 in the front of the main body portion 17, together with the recesses defined to create the mean tolerance surfaces 26 (the mean tolerance recesses), results in first and second forward extending members 35 that each include two protrusions 37 extending therefrom. The distal surfaces of the protrusions 37 include the maximum tolerance surfaces 28 thereon.

Figure 7A:
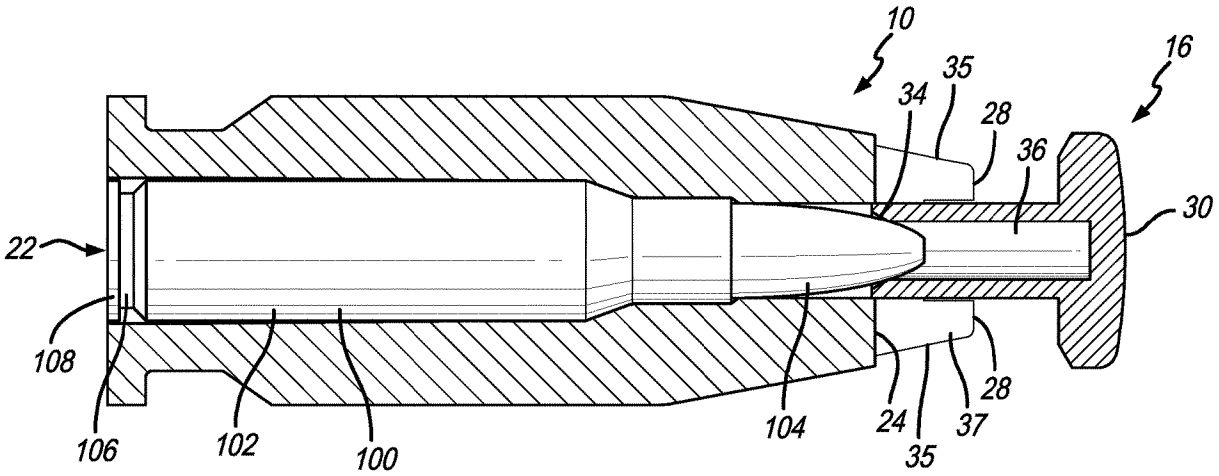
FIG. 7A is a cross-sectional elevational view of the cartridge tester with a cartridge stuck therein.
Figure 7B:
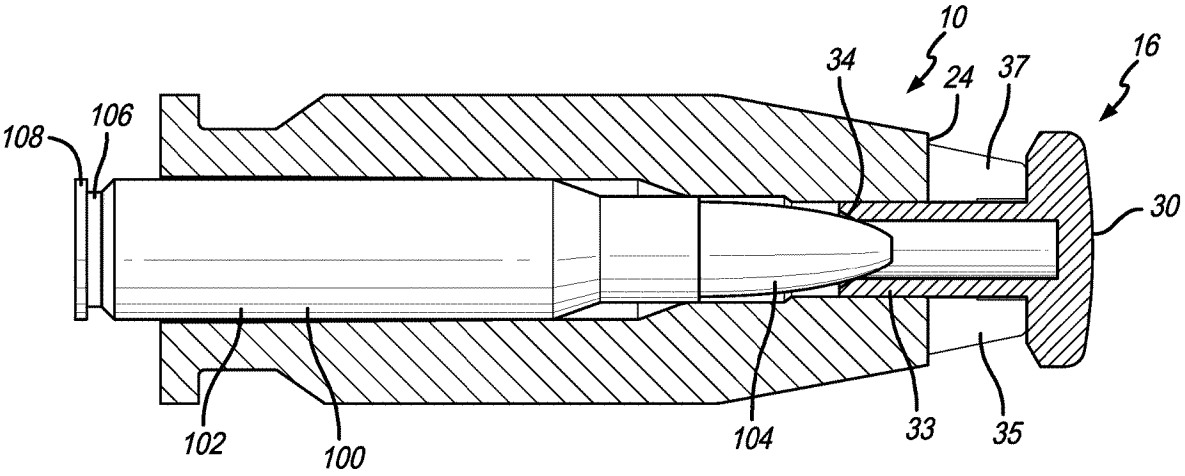
FIG. 7B is a cross-sectional elevational view of the cartridge tester after the cartridge has been pushed rearwardly using the bullet pusher.

As shown in FIGS. 7A-7B, in use, the concave front surface 34 is placed against the nose of the bullet and the user presses against the flange portion 30 to push the bullet 104 and case 102 (the cartridge 100) rearwardly and out of the through bore 18. In order to do this, the alignment portion 32 must be properly aligned with the complementary alignment recess 38.

Figure 8A:
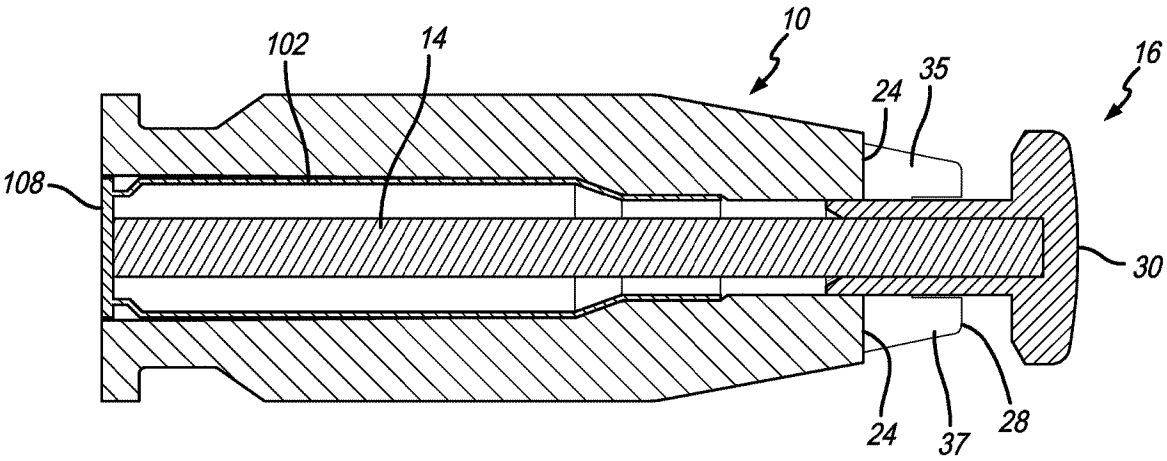
FIG. 8A is a cross-sectional elevational view of the cartridge tester with a case stuck therein.
Figure 8B:
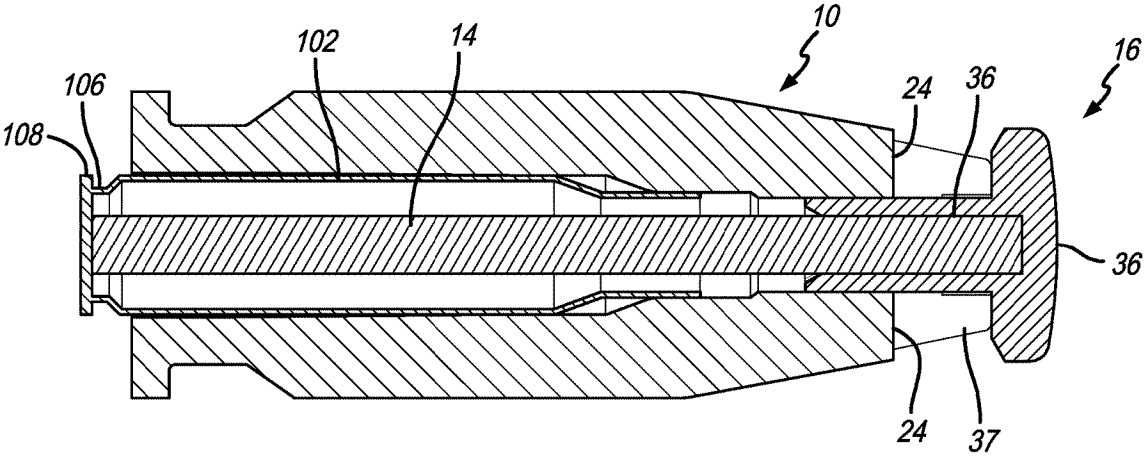
FIG. 8B is a cross-sectional elevational view of the cartridge tester after the case has been pushed rearwardly using the case pusher.

As shown in FIGS. 1, 2 and 8A-8B, in another situation, a used case 102 can be inserted into the through bore 18 to ensure it will fit into the firearm's chamber on reuse (after being reloaded with a bullet). As shown in FIGS. 1-2, in a preferred embodiment, the case pusher 14 is an elongated rod. The case pusher 14 is used to expel a stuck case (without a bullet therein) from the through bore 18. As shown in FIG. 8A, the case pusher 14 is inserted through the front opening 20 of the cartridge tester 10, into the case and against the rear wall of the case. Pressure is then applied rearwardly to expel the case, as shown in FIG. 8B. In a preferred embodiment, the bullet pusher 16 can be used in conjunction with the case pusher 14. However, this is not a limitation on the present invention. The maximum tolerance surface 28 can act as a stop for the flange portion 30 when expelling the case, as shown in FIG. 8B. In this embodiment, an end of the case pusher 14 is received in the case pusher opening 36 in the bullet pusher 16 and then the user pushes on the flange portion 30 to expel the case 102. Once again, the alignment portion 32 must be aligned with the alignment recess 38 to properly expel the case 102. It will be appreciated by those of ordinary skill in the art that the alignment portion 32 and alignment recess 38 prevent the case pusher 14 and/or bullet pusher 16 from being inserted too quickly. In other words, by making a user align these components properly they have to be careful in inserting the case pusher 14 and/or bullet pusher 16.

In another embodiment, the concave surface of the bullet pusher can be omitted and the bullet pusher can only be used with the case pusher. In another embodiment, the bullet pusher and case pusher can be unitary.

Figure 9:
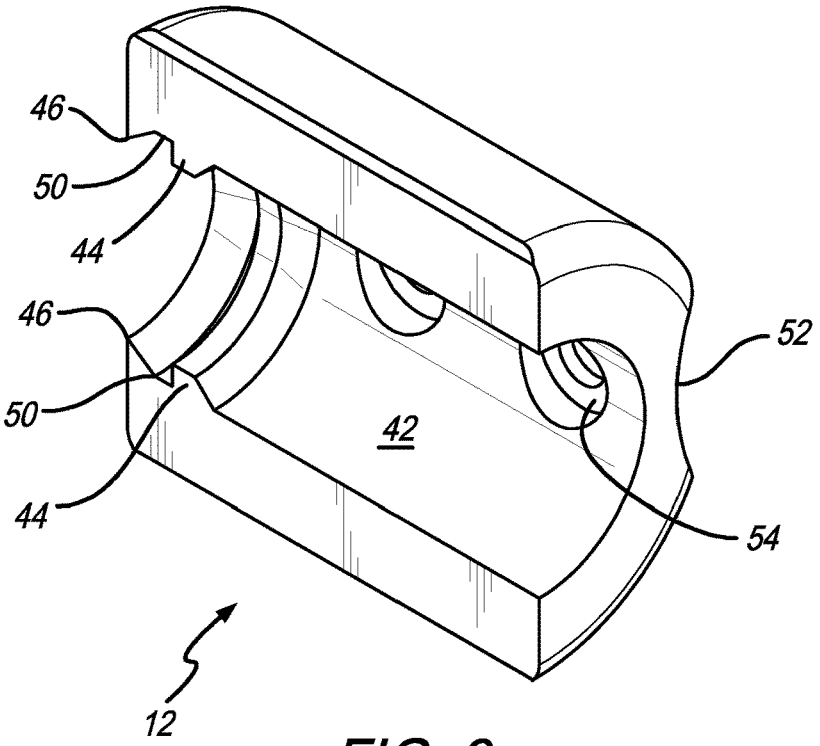
FIG. 9 is a perspective view of an extractor groove tester.
Figure 10:
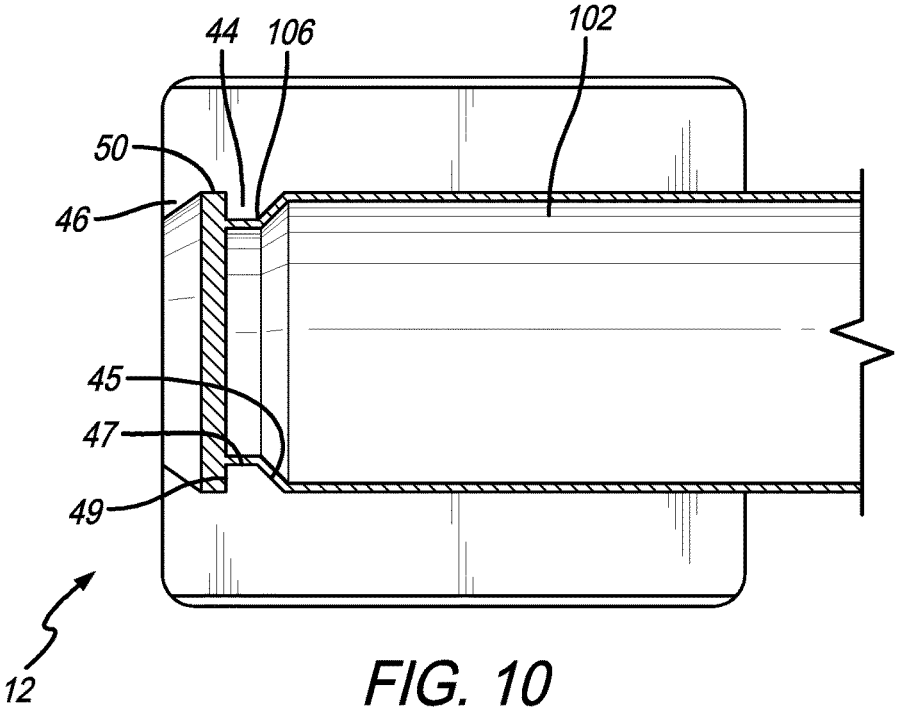
FIG. 10 is an elevational view of the extractor groove tester with a case inserted therein.

As shown in FIGS. 1 and 9-10, the extractor groove tester 12 includes a main body portion 40 that has a trough 42 defined therein and semi-annular first and second protrusions 44 and 46. The trough 42 includes an inner surface 48. A rim channel 50 is defined between the first and second protrusions 44 and 46.

In use, and entire cartridge 100 or case 102 (as shown in FIG. 10) is placed into the trough 42 such that the rim 108 is received in the rim channel 50 and the first protrusion 44 is received in the extractor groove 106 of the case 102. If the case 102 does not fit properly there is an issue. If the issue is minor, the case 102 can be spun so that the first protrusion 44 smoothes the extractor groove 106. This action helps prevent the case from getting stuck in the extractor during use of the firearm. Preferably, the extractor groove tester 12 is made of a hard material, such as hardened steel, and the first protrusion 44 includes a relatively sharp edge so that the a slightly damaged groove on a case can be smoothed out. In a preferred embodiment, first protrusion 44 includes a front inclined surface 45, an inner surface 47 (that is generally parallel to the axis of the main body portion 40) and a rear surface 49 (that is generally perpendicular to the axis of the main body portion 40) that are contacted by the inner surfaces of the extractor groove 106, as shown in FIG. 10. Second semi-annular protrusion 46 acts as a stop to the back of the rim 108 to help properly position the case 102 in the trough 42. It will be appreciated by those of ordinary skill in the art that the extractor groove tester 12 is used for checking and possibly correcting the extractor groove on a case.

In a preferred embodiment, the extractor groove tester 12 is secured or attached to the cartridge tester 10. As shown in FIGS. 1 and 2, in a preferred embodiment, the extractor groove tester 12 and cartridge tester 10 include openings 54 and 55 defined therein for receiving threaded fasteners 56 to secure the two components together. Preferably, the extractor groove tester 12 includes an axially extending attachment channel 52 on the outer surface thereof that mates with the outer surface of the main body portion 17 of the cartridge tester 10. In another embodiment, the extractor groove tester 12 and cartridge tester 10 can be separate components.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An ammunition inspection assembly comprising:

a cartridge tester that includes a main body portion having a bore extending axially therethrough, wherein the bore includes an inner surface, a front opening and a rear opening, wherein the bore is configured to receive a bullet cartridge therein, a bullet pusher, and a case pusher.

2. The ammunition inspection assembly of claim 1 wherein the main body portion of the cartridge tester includes a minimum tolerance surface flush with the front opening of the bore and a maximum tolerance surface positioned on a protrusion extending outwardly from the minimum tolerance surface.

3. The ammunition inspection assembly of claim 2 wherein the main body portion of the cartridge tester includes a mean tolerance surface positioned on the protrusion at a location between the minimum tolerance surface and the maximum tolerance surface.

4. The ammunition inspection assembly of claim 1 wherein the bullet pusher includes an alignment portion that is configured to be received in an alignment recess defined in the front of the cartridge tester.

5. The ammunition inspection assembly of claim 4 wherein the bullet pusher includes a pushing portion extending from the alignment portion, and wherein the pushing portion is configured to be received in the front opening of the bore of the cartridge tester.

6. The ammunition inspection assembly of claim 5 wherein the pushing portion has a concave front surface.

7. The ammunition inspection assembly of claim 6 wherein the bullet pusher includes a case pusher opening extending rearwardly from the concave front surface, and wherein the case pusher opening is configured to receive a portion of the case pusher therein.

8. The ammunition inspection assembly of claim 4 wherein an inner surface of the alignment recess defines a minimum tolerance surface that is flush with the front opening of the bore.

9. The ammunition inspection assembly of claim 8 wherein the alignment recess divides the front of the main body portion of the cartridge tester into first and second members that each include a maximum tolerance surface positioned on a protrusion extending outwardly therefrom.

10. The ammunition inspection assembly of claim 9 wherein a mean tolerance surface is positioned on each of the first and second protrusions at a location between the minimum tolerance surface and the maximum tolerance surface.

11. The ammunition inspection assembly of claim 1 further comprising a bullet case extractor groove tester secured to an outer surface of the cartridge tester, wherein the bullet case extractor groove tester includes a semi-circular shaped main body portion that includes a trough defined axially therethrough, wherein the trough includes an inner surface, wherein the trough includes first and second semi-annular protrusions that define a rim channel therebetween, and wherein the rim channel is configured to receive the rim of a bullet case and the first semi-annular protrusion is configured to be received in the extractor groove of the bullet case.

12. A bullet case extractor groove tester comprising:

a semi-circular shaped main body portion that includes a trough defined axially therethrough, wherein the trough includes an inner surface, wherein the trough includes first and second semi-annular protrusions that define rim channel therebetween, and wherein the rim channel is configured to receive the rim of a bullet case and the first semi-annular protrusion is configured to be received in the extractor groove of the bullet case.

13. The bullet case extractor groove tester of claim 12 wherein the first semi-annular protrusion includes a front inclined surface, an inner surface that is generally parallel to an axis of the main body portion, and a rear surface that is generally perpendicular to the axis of the main body portion.

14. The bullet case extractor groove tester of claim 12 wherein the main body portion includes an attachment channel defined therein.

15. The bullet case extractor groove tester of claim 14 wherein the attachment channel is defined axially in the main body portion.

* * * * *